US008876189B1

(12) United States Patent
Williams

(10) Patent No.: US 8,876,189 B1
(45) Date of Patent: Nov. 4, 2014

(54) VEHICLE MOUNTED CANOPY

(71) Applicant: Warren S. Williams, Shelbyville, IL (US)

(72) Inventor: Warren S. Williams, Shelbyville, IL (US)

( * ) Notice: Subject to any disclaimer, the term of this patent is extended or adjusted under 35 U.S.C. 154(b) by 0 days.

(21) Appl. No.: 13/846,445

(22) Filed: Mar. 18, 2013

(51) Int. Cl.
*E04H 15/08* (2006.01)
*B60J 7/02* (2006.01)

(52) U.S. Cl.
CPC ..... *B60J 7/02* (2013.01)
USPC ..... 296/163; 296/160

(58) Field of Classification Search
CPC ..... E04H 15/08; E04H 15/06
USPC ..... 296/160, 163
See application file for complete search history.

(56) References Cited

U.S. PATENT DOCUMENTS 3,040,756 A * 6/1962 Zerbe ..... 135/88.14
4,010,973 A 3/1977 Heinrich
4,754,774 A 7/1988 Leader
5,192,111 A 3/1993 Hanemaayer
7,798,547 B2 * 9/2010 Antaya ..... 296/26.13

FOREIGN PATENT DOCUMENTS

DE 3417698 A1 * 1/1986
GB 2107259 * 4/1983

* cited by examiner

*Primary Examiner* — Jason S Morrow
(74) *Attorney, Agent, or Firm* — Crossley Patent Law; Micah C. Gunn

(57) ABSTRACT

A vehicle mounted canopy including mounting brackets conforming to a vehicle roof with tracks attached thereto. Each outside track has stopping pins and a roller slidingly and rotationally disposed within the recess between the stopping pins to receive an inside track disposed on each side of a canopy frame that slidingly engage the respective outside track to extend the canopy frame. There is also a T-handle lock permitting a user to secure the inside track and outside track in a locked position in the mounting bracket and to alternately release the inside track and outside track from the mounting bracket to the stopping pins to permit usage of the canopy in an extended position.

12 Claims, 4 Drawing Sheets

VEHICLE MOUNTED CANOPY

BACKGROUND OF THE INVENTION

Various types of vehicle mounted awning devices are known in the prior art. However, what is needed is a vehicle mounted canopy including mounting brackets conforming to a vehicle roof that have outside tracks on each of the mounting brackets and a framed canopy has an inside track disposed on each side thereof that engage the outside tracks. The vehicle mounted canopy also includes a locking mechanism disposed on the outside of the canopy frame to lock the canopy within the outside track which will allow the user to travel without the concern of the canopy sliding to an open position while driving.

FIELD OF THE INVENTION

The present invention relates to awning devices for a motor vehicle, and more particularly, to a vehicle mounted canopy that can be mounted to the roof of any vehicle.

SUMMARY OF THE INVENTION

The general purpose of the present vehicle mounted canopy, described subsequently in greater detail, is to provide a vehicle mounted canopy which has many novel features that result in a vehicle mounted canopy which is not anticipated, rendered obvious, suggested, or even implied by prior art, either alone or in combination thereof.

To accomplish this, the present vehicle mounted canopy includes a mounting bracket transversely disposed on and conforming to a vehicle roof with an outside track on each of the mounting brackets. Each of the outside tracks has an outer surface, an upper inner surface that is spaced apart from a bottom inner surface, and a recess continuously disposed between the upper and bottom inner surfaces with the upper and bottom inner surfaces of each outside track facing each other. A stopping pin is disposed in the recess proximal to the bottom inner surface at the outer edge and the center portion of the outside track with a roller disposed within the recess between the stopping pins. The stopping pins allow a canopy to extend for usage while preventing disengagement from the mounting brackets. There is also a inside track slidingly disposed within the outside track recess to allow the inside track to slidingly engage the roller within the recess. The vehicle mounted canopy also includes the canopy with a frame disposed around the perimeter of the entire canopy to allow the canopy to extend from the outside track recess. There is also a locking mechanism disposed on the outside of the canopy frame to lock the canopy within the outside track. The locking mechanism secures the inside track and outside track in a locked position in the mounting bracket and alternately releases the inside track from the outside track from the mounting bracket to permit usage of the canopy in an extended position.

The canopy can be formed of fiberglass or alternately can be formed of plywood or any other material that would provide shelter from weather.

The present vehicle mounted canopy allows the user to have shelter at any time he desires outside of their vehicle for purposes such as tailgating, recreational activities, craft shows, or hunting.

Thus has been broadly outlined the more important features of the present vehicle mounted canopy so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
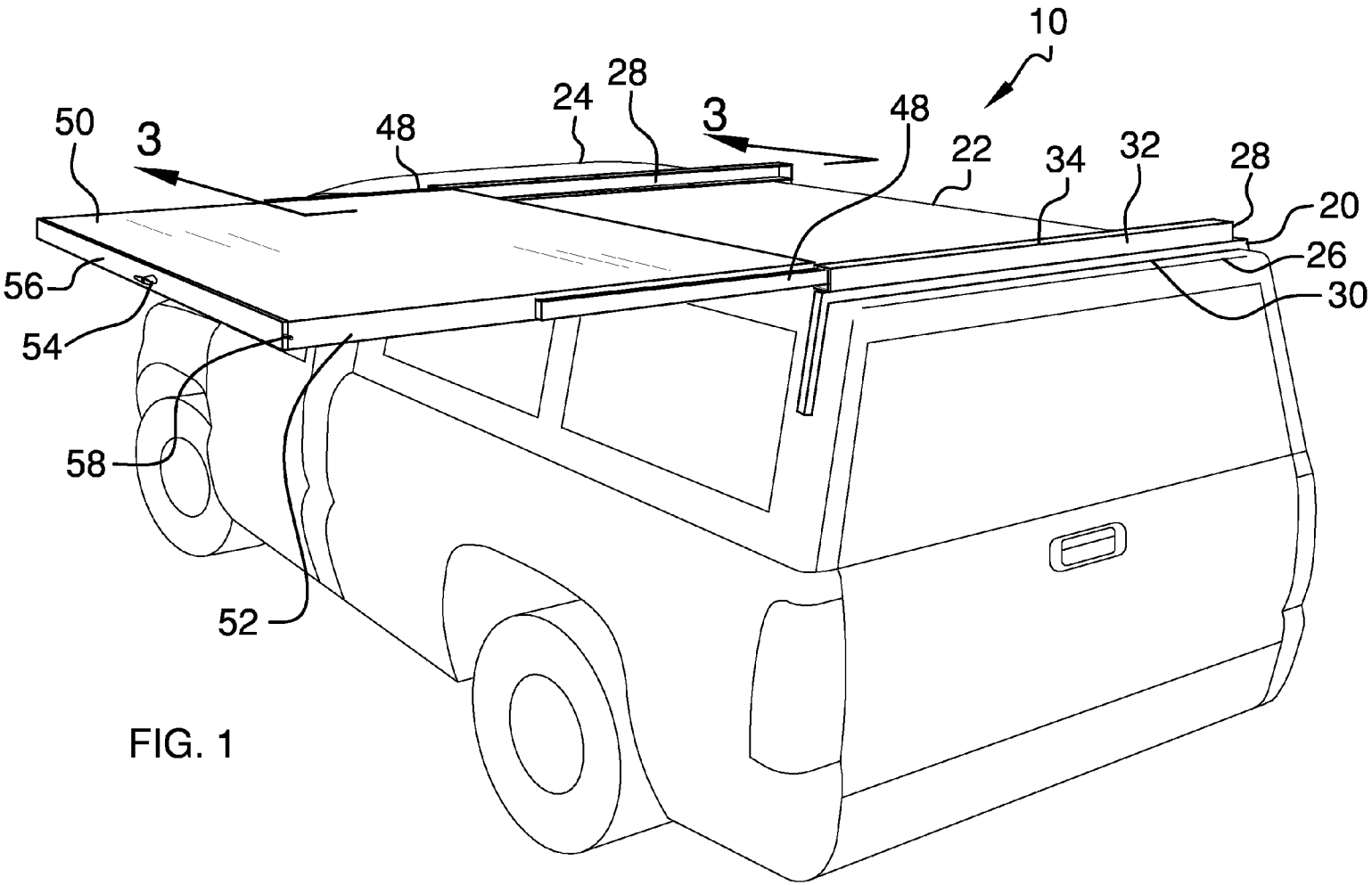
FIG. 1 is an in-use isometric view illustrated in an extended position and mounted to a vehicle roof.
Figure 2A:
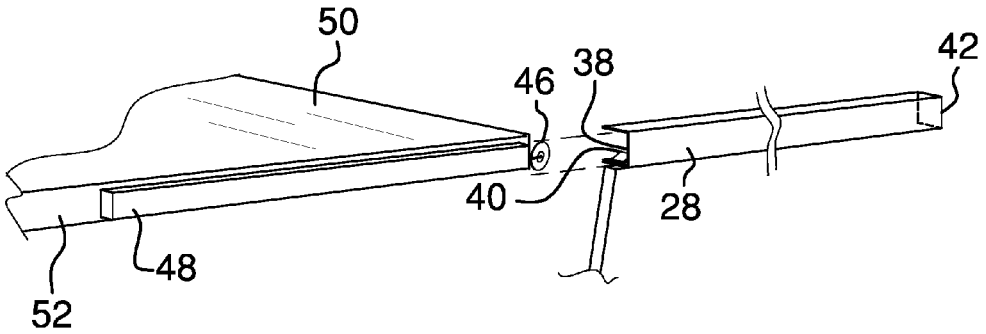
FIG. 2A is a detailed exploded view showing that an inside track engages an outside track.
Figure 2:
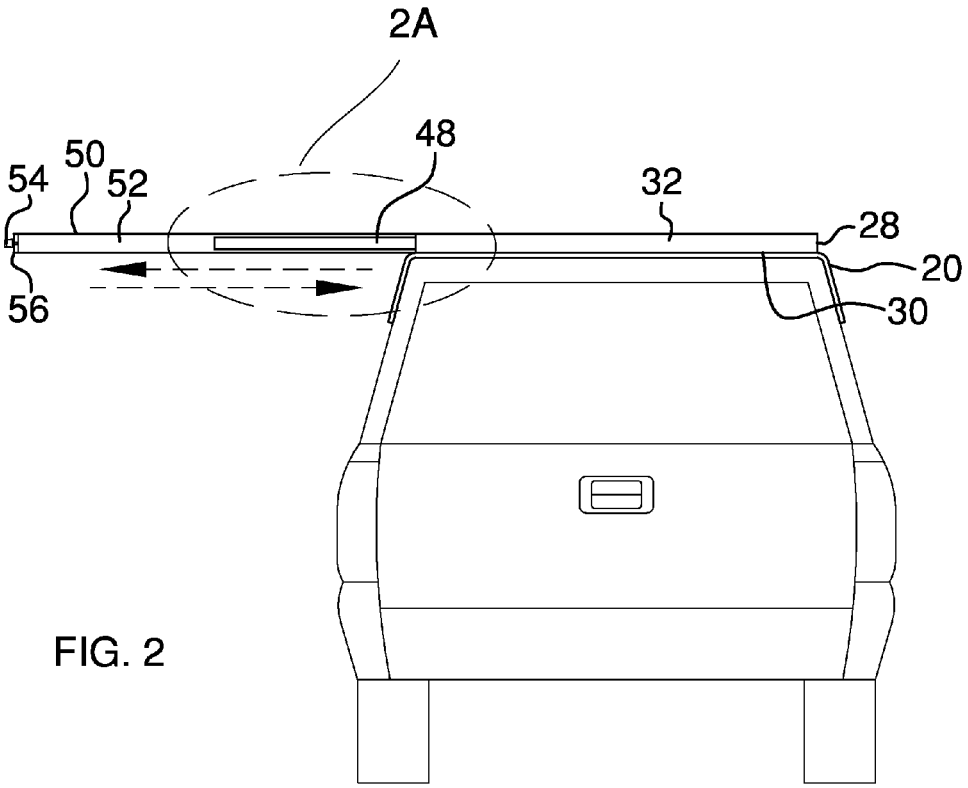
FIG. 2 is an in-use rear elevation view shown in the extended position and mounted to the vehicle roof.
Figure 3:
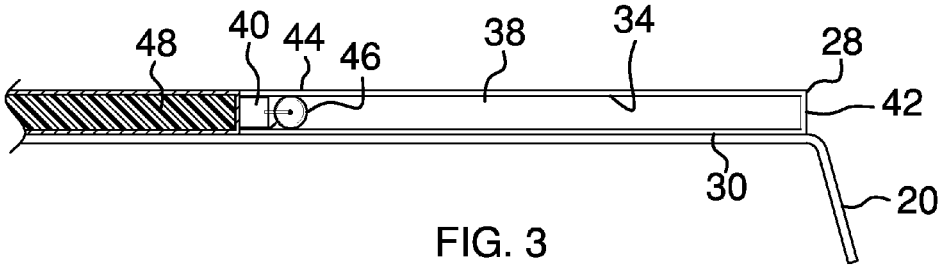
FIG. 3 is a cross-sectional view taken along line 3-3 of FIG. 1.
Figure 4:
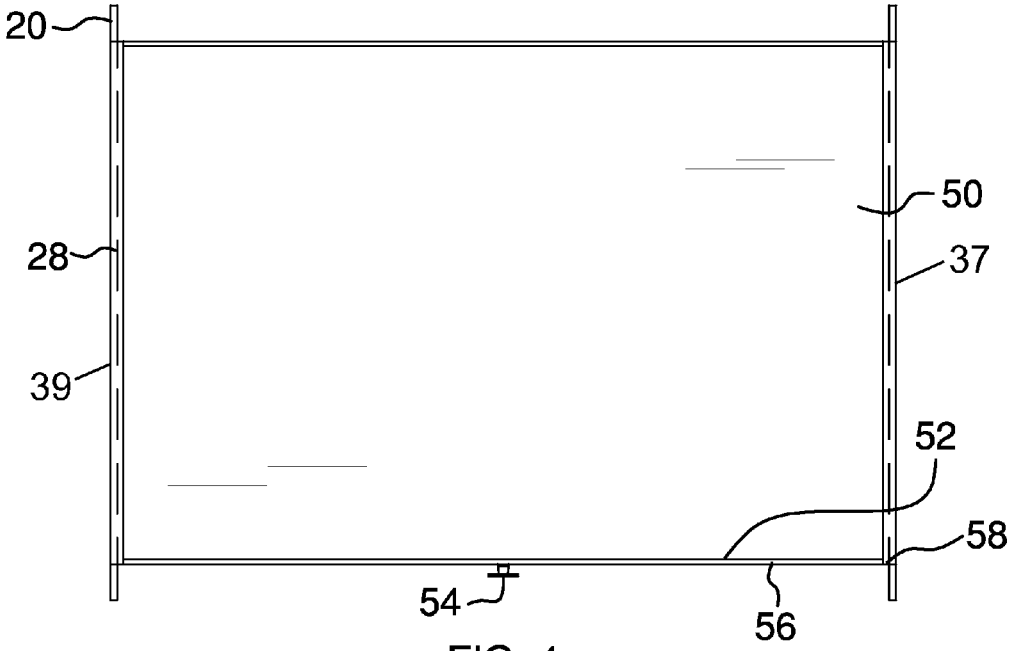
FIG. 4 is a top plan view shown in a retracted position.
Figure 5:
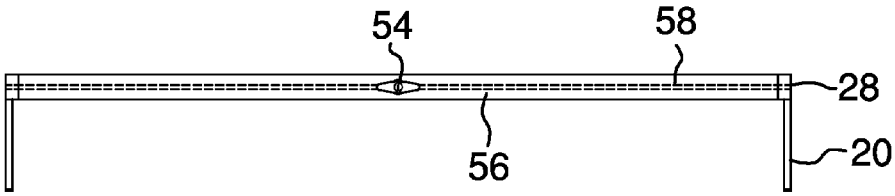
FIG. 5 is a front elevation view illustrated in a retracted position.
Figure 6:
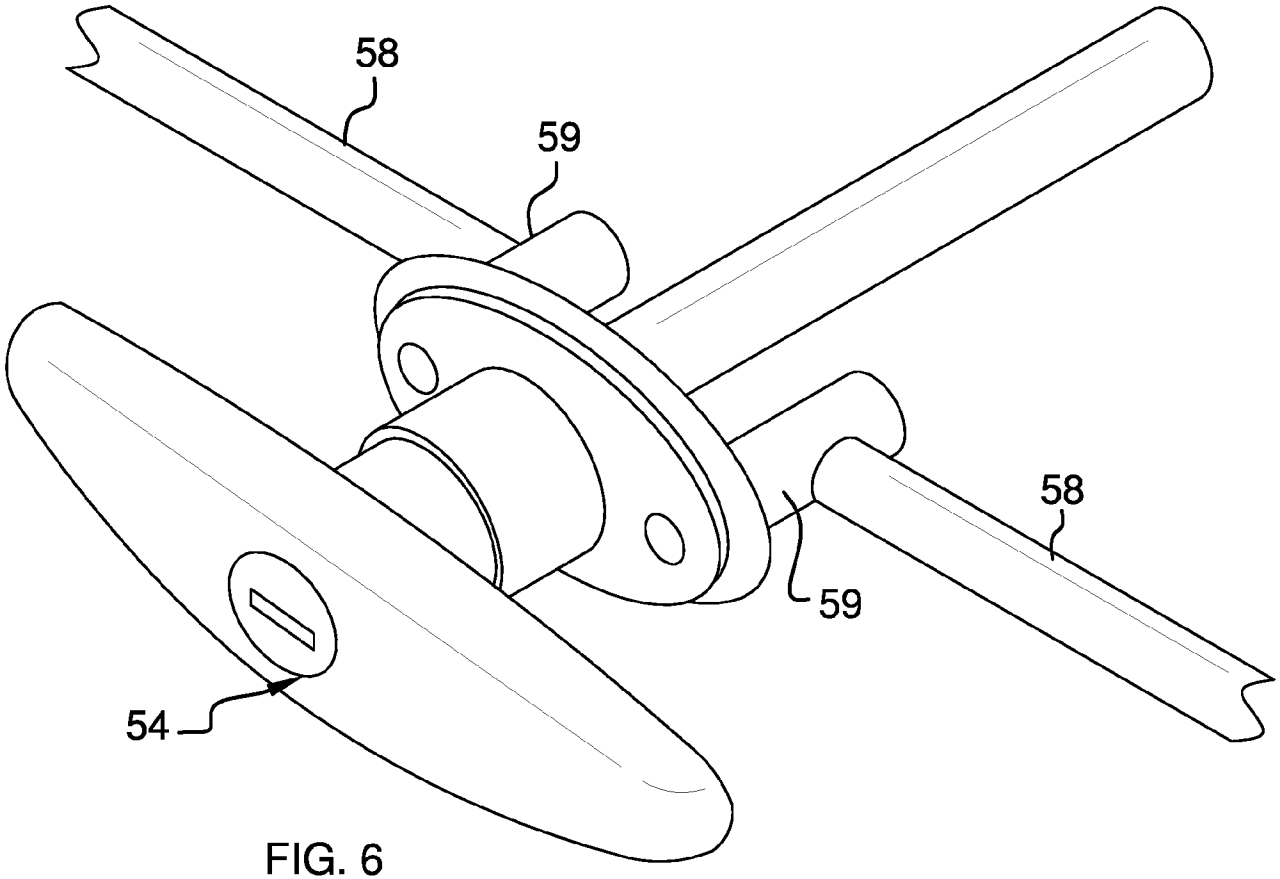
FIG. 6 is an isometric view of a T-handle lock.

With reference now to the drawings, and in particular FIGS. 1 through 6 thereof, example of the instant vehicle mounted canopy employing the principles and concepts of the present vehicle mounted canopy and generally designated by the reference number 10 will be described.

Referring to FIGS. 1 through 6 a preferred embodiment of the present vehicle mounted canopy 10 is illustrated. The vehicle mounted canopy 10 includes a mounting bracket 20 transversely disposed on a vehicle roof 22 proximal to each of a front edge 24 and a rear edge 26 of the vehicle roof 22. Each mounting bracket 20 is configured to conform to the vehicle roof 22. An outside track 28 is disposed on a top wall 30 of each of the mounting brackets 20, each outside track 28 comprising an outer surface 32, an upper inner surface 34 spaced apart from a bottom inner surface 36, and a recess 38 continuously longitudinally disposed therebetween. The upper and bottom inner surfaces 34, 36 of each outside track 28 face each other with stopping pins 40 disposed within the recess 38 proximal the bottom inner surface 36 on each of an outer edge 42 of the recess 38 and a center portion 44 of the outside track 28.

A inside track 48 slidingly engages the outside track 28 recess 38. The inside track 48 has a closed square cross-sectional shape. A roller 46 disposed on an inner wall 49 of the inside track slidingly and rotationally engages the recess 38 between the stopping pins 40. The stopping pins 40 prevent the inside track 48 from disengaging the outside track 28. The inside track 48 has a channel therethrough.

The vehicle mounted canopy 10 also comprises a canopy 50 having a frame 52 disposed along the perimeter thereof. The inside track recess 38 is disposed on each of a right side 37 and a left side 39 of the frame 52. The vehicle mounted canopy 10 also comprises a keyed T-handle lock 54 that is centrally disposed on the outer wall 56 of the canopy frame 52. The lock rods 58 are continuously longitudinally disposed within the frame 52 of the canopy 50 on each of a side 59 of the T-handle lock 54 and rotationally engage the keyed T-handle lock 54. The keyed T-handle lock 54 is configured to accept a key. The T-handle lock 54 permits a user to secure the inside track 48 and outside track 28 in a locked position in the mounting bracket 20 and to alternately release the inside track 48 and the outside track 28 from the mounting bracket 20 to permit usage of the canopy 50 in an extended position. The inside track 48 and the frame 52 move relative to each other in the same way that the inside track 48 engages the outside track 28.

The lock rods 58 have a diameter of approximately one-quarter inch.

What is claimed is:

1. A vehicle mounted canopy comprising:

a mounting bracket transversely disposed on a vehicle roof proximal to each of a front edge and a rear edge of the vehicle roof; wherein each mounting bracket is configured to conform to the vehicle roof;

an outside track disposed on a top wall of each of the mounting brackets, each outside track comprising:

an outer surface, an upper inner surface spaced apart from a bottom inner surface, and a recess continuously longitudinally disposed therebetween, wherein the upper and bottom inner surfaces of each track face each other;

a stopping pin disposed within the recess proximal the bottom inner surface on each of an outer edge of the recess and a center portion of the outside track;

an inside track slidingly engaging the outside track recess, wherein the inside track has a closed square cross-sectional shape;

a roller disposed on an inner wall of the inside track, wherein the roller slidingly and rotationally engages the outside track recess between the stopping pins;

a canopy having a frame disposed along the perimeter thereof, wherein the inside track is disposed on each of a left side and a right side of the frame.

2. The vehicle mounted canopy of claim 1 further comprising:

a locking mechanism disposed on the frame, wherein the locking mechanism is configured to secure the canopy within the outside track.

3. The vehicle mounted canopy of claim 2 wherein the locking mechanism further comprises:

a T-handle lock centrally disposed on an outer wall of the canopy frame;

a pair of lock rods continuously longitudinally disposed within the frame of the canopy; and wherein the lock rods rotationally engage the T-lock handle.

4. The vehicle mounted canopy of claim 3 wherein the locking mechanism wherein the T-handle lock is keyed.

5. A vehicle mounted canopy comprising:

a mounting bracket transversely disposed on a vehicle roof proximal to each of a front edge and a rear edge of the vehicle roof; wherein each mounting bracket is configured to conform to the vehicle roof;

an outside track disposed on a top wall of each of the mounting brackets, each outside track comprising:

an outer surface, an upper inner surface spaced apart from a bottom inner surface, and a recess continuously longitudinally disposed therebetween, wherein the upper and bottom inner surfaces of each track face each other;

a stopping pin disposed within the recess proximal the bottom inner surface on each of an outer edge of the recess and a center portion of the outside track;

an inside track slidingly disposed within the outside track recess, wherein the inside track has a closed square cross-sectional shape, a roller disposed on an inner wall of the inside track, wherein the roller slidingly and rotationally engages the outside track recess between the stopping pins;

a canopy having a frame disposed along the perimeter thereof, wherein the inside track is disposed on each of a left side and a right side of the frame;

a locking mechanism disposed on the frame, wherein the locking mechanism is configured to secure the canopy within the outside track;

a T-handle lock centrally disposed on an outer wall of the canopy frame;

a pair of lock rods continuously longitudinally disposed within the frame of the canopy, wherein the lock rods are disposed on each of a side of the lock;

wherein the lock rods rotationally engage the T-lock handle;

wherein upon the rotational engagement of the lock rods and the T-handle lock, the lock rods are disposed in a locked and alternate unlocked position; and wherein upon the disposition of the lock rods in an unlocked position, the inside track is extendible from the outside track and the frame is extendible from the inside track.

6. The vehicle mounted canopy of claim 5 wherein the T-handle lock is keyed.

7. The vehicle mounted canopy of claim 5 wherein the canopy is formed of fiberglass and alternately plywood.

8. The vehicle mounted canopy of claim 6 wherein the canopy is formed of fiberglass.

9. The vehicle mounted canopy of claim 6 wherein the canopy is formed of plywood.

10. A vehicle mounted canopy comprising:

a mounting bracket transversely disposed on a vehicle roof proximal to each of a front edge and a rear edge of the vehicle roof; wherein each mounting bracket is configured to conform to the vehicle roof;

an outside track disposed on a top wall of each of the mounting brackets, each outside track comprising:

an outer surface, an upper inner surface spaced apart from a bottom inner surface, and a recess continuously longitudinally disposed therebetween, wherein the upper and bottom inner surfaces of each track face each other;

a stopping pin disposed within the recess proximal the bottom inner surface on each of an outer edge of the recess and a center portion of the outside track;

an inside track slidingly disposed within the outside track recess, wherein the inside track has a closed square cross-sectional shape, wherein the inside track slidingly engages the roller within the recess;

a roller disposed on an inner wall of the inside track, wherein the roller slidingly and rotationally engages the outside track recess between the stopping pins;

a canopy having a frame disposed along the perimeter thereof, wherein the inside track is disposed on each of a left side and a right side of the frame;

a keyed T-handle lock centrally disposed on an outer wall of the canopy frame;

a pair lock rods continuously longitudinally disposed within the frame of the canopy on each of a side of the T-handle lock;

wherein the lock rods rotationally engage the keyed T-lock handle;

wherein upon the rotational engagement of the lock rods and the T-handle lock, the lock rods are disposed in a locked and alternate unlocked position;

wherein upon the disposition of the lock rods in an unlocked position, the inside track is extendible from the outside track and the frame is extendible from the inside track; and wherein the keyed T-handle lock is configured to accept a key.

11. The vehicle mounted canopy of claim 10 wherein the canopy is formed of fiberglass.

12. The vehicle mounted canopy of claim 10 wherein the canopy is formed of plywood.

* * * * *